US007579937B2

(12) United States Patent
Arata et al.

(10) Patent No.: US 7,579,937 B2
(45) Date of Patent: Aug. 25, 2009

(54) LAMINATED INDUCTOR AND METHOD OF MANUFACTURE OF SAME

(75) Inventors: Masazumi Arata, Tokyo (JP); Kunihiko Kawasaki, Tokyo (JP); Kunio Oda, Tokyo (JP); Yohei Tadaki, Tokyo (JP); Yoshimitsu Satoh, Tokyo (JP); Hitoshi Sasaki, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/250,926

(22) Filed: Oct. 14, 2008

(65) Prior Publication Data

US 2009/0115563 A1 May 7, 2009

(30) Foreign Application Priority Data

Nov. 7, 2007 (JP) ..... 2007-290048
Nov. 7, 2007 (JP) ..... 2007-290052

(51) Int. Cl.
*H01F 5/00* (2006.01)

(52) U.S. Cl. ..... 336/200

(58) Field of Classification Search ..... None
See application file for complete search history.

(56) References Cited

U.S. PATENT DOCUMENTS 5,515,022 A * 5/1996 Tashiro et al. ..... 336/200
6,504,466 B1 1/2003 Katsurada
6,551,426 B2 * 4/2003 Okuyama et al. ..... 156/89.12
6,992,556 B2 * 1/2006 Tada et al. ..... 336/200

FOREIGN PATENT DOCUMENTS

JP A-06-061084 3/1994
JP B2-07-123091 12/1995
JP B2-2921594 4/1999
JP B2-3582454 8/2004
JP A-2006-041017 2/2006
JP 2006256942 A * 9/2006

* cited by examiner

*Primary Examiner*—Tuyen Nguyen
(74) *Attorney, Agent, or Firm*—Oliff & Berridge, PLC

(57) ABSTRACT

A laminated inductor, as well as a method of manufacturing such a laminated inductor, are provided. The laminated inductor includes: a laminate; a pair of external electrodes arranged on the outer surfaces of the laminate respectively; and a coil, arranged within the laminate and formed by electrically connecting a plurality of strip-like conductor patterns. The conductor patterns have: a pair of broad faces, intersecting the lamination direction and mutually opposing; and peripheral side faces adjacent to the pair of broad faces and extending in the lamination direction. The peripheral side faces are concavo-convex faces, in which concave portions and convex portions are arranged in alternation in the lamination direction. The laminate enters into the concave portions of the peripheral side faces.

11 Claims, 10 Drawing Sheets

(a)

(b)

LAMINATED INDUCTOR AND METHOD OF MANUFACTURE OF SAME

BACKGROUND OF THE INVENTION

1. Field of the Invention

This invention relates to a laminated inductor, and to a method of manufacture of a laminated inductor.

2. Related Background Art

In the prior art, methods are known for the manufacture of couplers and other electronic components in which laser light is used to form grooves in a green sheet, and the grooves are filled with a conductive paste, for the purpose of increasing the thickness of the conduction pattern and reducing electrical resistance (see for example Patent Literature 1). An electronic component manufactured by such a method of electronic component manufacture comprises a laminate, in which a plurality of insulator layers are laminated, and a strip-like conductor pattern positioned within the laminate. The conductor pattern has a pair of broad faces, and peripheral side faces which connect the pair of broad faces over the entire perimeter of the pair of broad faces.

Patent Literature 1: Japanese Unexamined Patent Publication No. 2006-041017

SUMMARY OF THE INVENTION

In recent years there have been demands for laminated inductors for use as power supply choke coils in for example portable telephones which have satisfactory DC superposition characteristics (small DC resistance values) and small decreases in the inductance value even when large DC currents (for example, approximately 1 A to 5 A) are passed. To this end, by adopting the above-described method of electronic component manufacture of the prior art, a laminated inductor having thick conductor patterns may be obtainable.

However, when adopting a method of electronic component manufacture of the prior art, in general the conductive paste and the green sheet are prepared such that the shrinkage rate of the conductive paste during burning is greater than the shrinkage rate of the green sheet during burning; and so to the extent that the conductor pattern thickness is increased, a gap tends to occur between the peripheral side faces of the conductor pattern in the manufactured laminated inductor and the portions of the laminate in contact with the side faces. For this reason, the occurrence of gaps is accompanied by advancing separation between the peripheral side faces of the conductor pattern and the portions of the laminate in contact with the peripheral side faces, and there has been the problem that cracking occurs in portions of the laminate positioned between adjacent conductor patterns in the lamination direction. When such cracking occurs, due to a migration phenomenon in which the conductor pattern moves within the crack, there is the possibility of short-circuits between adjacent conductor patterns.

Hence, this invention has as an object the provision of a laminated inductor, in which cracks are highly unlikely to occur in portions positioned between adjacent conductor patterns in the lamination direction within the laminate, even when the conductor pattern thickness is large, as well as a method of manufacture of such a laminated inductor.

A laminated inductor of this invention has a laminate formed by laminating a plurality of insulator layers; first and second external electrodes positioned on outer surfaces of the laminate respectively; a coil, formed by electrically connecting a plurality of strip-like conductor patterns, and arranged within the laminate; a first leading conductor, electrically connected to one end of the coil, and electrically connected to the first external electrode; and a second leading conductor, electrically connected to the other end of the coil, and electrically connected to the second external electrode; the conductor pattern has first and second broad faces, mutually opposing in the lamination direction of the laminate, and peripheral side faces connecting the first and second broad faces over the entire perimeter of the first and second broad faces, and is set to have a thickness of 20 μm or greater; the peripheral side faces have concave portions extending along the peripheral direction and convex portions extending along the peripheral direction, which are arranged in alternation along the lamination direction to form concavo-convex faces; and by causing a portion of the laminate to enter into the concave portions of the peripheral side faces, the conductor pattern, seen from the lamination direction, has overlapping portions, in which portions, of the laminate, which enter into the concave portions in the peripheral side faces overlap the conductor pattern, and non-overlapping portions which are portions other than the overlapping portions.

In a laminated inductor of this invention, peripheral side faces of the conductor pattern form concavo-convex faces, with alternation of concave portions and convex portions of the peripheral side face in the lamination direction, and with a portion of the laminate entering into the concave portions of the peripheral side faces. As a result, due to a so-called anchor effect, there is extremely little tendency for separation of the portions of the laminate in contact with the peripheral side faces of the conductor pattern from the concavo-convex shape peripheral side faces. As a result, even when the conductor pattern is thick (20 μm or greater), there is extremely little tendency for cracking to occur in portions of the laminate positioned between adjacent conductor patterns in the lamination direction. Hence, concerns about short-circuits between adjacent conductor patterns due to the migration phenomenon are greatly reduced.

It is preferable that the width of the conductor pattern be set to greater than 60 μm, and that the width of the overlapping portions be set to 20 μm or greater, and moreover be smaller than the width of the non-overlapping portions. If the width of overlapping portions is less than 20 μm, there is a tendency for the anchor effect (the effect of impeding separation of the concavo-convex shape peripheral side faces from the laminate) occurring due to the concavo-convex shape peripheral side faces of the conductor pattern to be inadequate. If the width of the overlapping portions is equal to or greater than the width of the non-overlapping portions, the relative cross-sectional area of the conductor pattern is small, and there is a tendency for the DC resistance value of the laminated inductor to be high; such a laminated inductor is not well-suited to large-current applications.

It is preferable that the tips of the convex portions in the peripheral side faces have a tapered shape. By this means, there is extremely little tendency for the portions of the laminate in contact with the peripheral side faces of the conduction pattern to separate from the concavo-convex shape peripheral side faces.

It is preferable that the laminate have first and second main faces, which intersect the lamination direction and are mutually opposed, and that the conductor pattern is arranged within the laminate such that the first broad faces are closer to the first main face and the second broad faces are closer to the second main face, that the tips of convex portions, when seen from the lamination direction, substantially coincide with edges of the first and second broad faces, so that as a result bottoms of the concave portions overlap the first and second broad faces when seen from the lamination direction, that regions on the first broad faces in the overlapping portions are in contact with the laminate, and that a gap is formed between a portion of the regions of the first broad faces in the non-overlapping portions and the laminate. By this means, because the relative permittivity of air is lower than the relative permittivity of the laminate, the distributed capacitance is small. As a result, losses at high frequencies can be made small.

It is still more preferable that the conductor pattern have end portions connected to through-hole conductors extending in the lamination direction, that the conductor pattern and through-hole conductors be connected via connection conductors provided only at the end portions of the conductor pattern, and that the connection conductors be arranged so as to be larger than the through-hold conductors when seen from the lamination direction and so as to be within regions in the non-overlapping portions of the first broad faces. By this means, the conductor pattern and through-hole conductors can be reliably connected by the connection conductors, so that the reliability of connection can be greatly enhanced.

On the other hand, a method of manufacturing a laminated inductor of this invention is characterized in comprising a green sheet preparation process of preparing a green sheet; a first conductive film formation process of forming a strip-like first conductive film by applying a conductive paste onto the green sheet in a prescribed pattern and performing drying; a first ceramic film formation process of applying a ceramic slurry so as to cover the edge portions of the first conductive film and expose an upper face of the first conductive film other than the edge portions, and performing drying to form a first ceramic film; a second conductive film formation process of applying a conductive paste on the exposed face of the first conductive film and on the first ceramic film in the prescribed pattern and performing drying, in order to form a strip-like second conductive film, which overlaps with the first conductive film when seen from the lamination direction; and, a second ceramic film formation process of applying a ceramic slurry so as to cover the edge portions of the second conductive film and expose an upper face of the second conductive film other than the edge portions, and performing drying, in order to form a second ceramic film.

In a method of manufacturing a laminated inductor of this invention, a first ceramic film is formed so as to cover the edge portions of the first conductive film as well as exposing the upper face of the first conductive film other than the edge portions, a second conductive film is formed on the exposed face of the first conductive film and on the first ceramic film with the same pattern as the first conductive film, and a second ceramic film is formed so as to cover the edge portions of the second conductive film while exposing the upper face of the second conductive film other than the edge portions. Hence, by means of this method of manufacture of laminated inductors of the invention, a laminated inductor can be manufactured in which the peripheral side faces of the conductor pattern form the concavo-convex faces in which the concave portions and the convex portions alternate in the lamination direction, and moreover the laminate enters into the depressed portions of the peripheral side faces. As a result, because of the so-called anchor effect, there is extremely little tendency for separation of the laminate from the concavo-convex shape peripheral side faces, and there is extremely little tendency for cracks to occur in the portions of the laminate positioned between adjacent conductor patterns in the lamination direction. Hence, concerns about short-circuits between adjacent conductor patterns due to the migration phenomenon are greatly reduced.

It is preferable that in the first ceramic film formation process, the first ceramic film be formed such that the height of the first ceramic film from the green sheet is higher than the height of the first conductive film from the green sheet, and that in the second ceramic film formation process, the second ceramic film be formed such that the height of the second ceramic film from the green sheet is higher than the height of the second conductive film from the green sheet. By this means, when a plurality of green sheets are laminated, the green sheet laminate as a whole can be uniformly pressure-bonded. As a result, the occurrence of interlayer separation within the manufactured laminated inductor can be adequately suppressed.

It is still more preferable that the through-hole formation process of forming through-holes penetrating the green sheet in the thickness direction be further comprised after the green sheet preparation process and before the first conductive film formation process, and that connection conductive film formation processes be further comprised in which, in the first conductive film formation process, by filling the through-holes with conductive paste as well as applying conductive paste onto the green sheet in a prescribed pattern and performing drying, the strip-like first conductive film is formed, and after the second ceramic film formation process, by applying conductive paste only to an end portion of the second conductive film which are the exposed face of the second conductive film and then performing drying, the connection conductive film is formed the height of which from the green sheet is greater than the height of the ceramic film from the green sheet. In this way, when laminating a plurality of green sheets, the connection conductive film formed on the exposed face of the second conductive film on one green sheet is crushed by the other green sheet adjacent to this green sheet, and by means of this connection conductive film, the second conductive film on one green sheet is reliably connected to the portion of the first conductive film on the other green sheet which fills through-holes formed in the other green sheet, to greatly improve the reliability of connection. Hence, both suppression of interlayer separation, and reduction of connection faults can be achieved.

It is still more preferable that the shrinkage rate during burning of the connection conductive film be smaller than the shrinkage rate during burning of the conductive film. By this means, there is little tendency for shrinkage of the connection conductive film during burning, so that even after burning, the connection between the second conductive film on one green sheet and the portion of the first conductive film on other green sheet which fills through-holes formed in the other green sheet can be reliably maintained. As a result, connection faults can be further reduced.

Further, a method of manufacturing a laminated inductors of this invention comprises a green sheet preparation process of preparing a green sheet; a through-hole formation process of forming through-holes in the green sheet, which penetrates in the thickness direction; a first conductive film formation method of forming a strip-like first conductive film by filling the through-holes with conductive paste and applying conductive paste onto the green sheet in a prescribed pattern and performing drying; a first ceramic film formation method of applying a ceramic slurry so as to cover edge portions of the first conductive film and expose the upper face of the first conductive film other than the edge portions, and performing drying, in order to form a first ceramic film having the height, from the green sheet, greater than the height of the first conductive film from the green sheet; an $n^{th}$ conductive film formation process of forming a strip-like $n^{th}$ (where $n^{th}$ is an integer equal to or greater than 2) conductive film; an $n^{th}$ ceramic film formation process of forming an $n^{th}$ ceramic film; and, a connection conductive film formation process; and wherein, in the $n^{th}$ conductive film formation process, by applying conductive paste in the prescribed pattern onto the exposed face of the $m^{th}$ (where m is the integer satisfying m=n−1) conductive film and onto the $m^{th}$ ceramic film and by performing drying, the $n^{th}$ conductive film is formed so as to overlap the $m^{th}$ conductive film when seen from the lamination direction and to have the height, from the green sheet, greater than the height of the $m^{th}$ ceramic film from the green sheet; in the $n^{th}$ ceramic film formation process, by applying ceramic slurry so as to cover edge portions of the $n^{th}$ conductive film and expose the upper face of the $n^{th}$ conductive film other than the edge portions and by performing drying, the $n^{th}$ ceramic film is formed to have the height, from the green sheet, greater than the height of the $n^{th}$ conductive film from the green sheet; and, in the connection conductive film formation process, by applying conductive paste only onto end portions of the $n^{th}$ conductive film which is the exposed face and by performing drying, the connection conductive film is formed to have the height, from the green sheet, greater than the height of the $n^{th}$ ceramic film from the green sheet.

In a method of manufacturing a laminated inductor of this invention, the $m^{th}$ ceramic film is formed so as to cover the edge portions of the $m^{th}$ conductive film and expose the upper face of the $m^{th}$ conductive film other than the edge portions, the $n^{th}$ conductive film is formed on the exposed face of the $m^{th}$ conductive film and the $m^{th}$ ceramic film with the same pattern as the $m^{th}$ conductive film, and the $n^{th}$ ceramic film is formed so as to cover the edge portions of the $n^{th}$ conductive film and expose the upper face of the $n^{th}$ conductive film other than the edge portions. Hence, by means of a method of manufacture of laminated inductors of this invention, the peripheral side faces of the conductor pattern are formed as concavo-convex faces in which concave portions and convex portions are alternated in the lamination direction, and a laminated inductor can be manufactured with the laminate entering into the concave portions of the peripheral side faces. As a result, due to the so-called anchor effect, there is extremely little tendency for separation of the laminate from the depression/protrusion shape peripheral side faces, and so there is very little tendency for cracking to occur in the portions of the laminate positioned between adjacent conductor patterns in the lamination direction. Hence, concerns about short-circuits between adjacent conductor patterns due to the migration phenomenon are greatly reduced.

Further, in a method of manufacture of laminated inductors of this invention, the $n^{th}$ ceramic film is formed such that the edge portions of the $n^{th}$ conductive film are covered and the upper face of the conductive film other than the edge portions is exposed, and such that the height of the $n^{th}$ ceramic film from the green sheet is greater than the height of the $n^{th}$ conductive film from the green sheet. Hence, compared with manufacturing methods of the prior art in which an auxiliary magnetic material layer was formed so as to surround the perimeter of the conductor pattern, when a plurality of green sheets are laminated, the area of contact between the $n^{th}$ ceramic film formed on one green sheet and other green sheet adjacent to the one ceramic film increases, and by means of the edge portions of the $n^{th}$ conductive film, together with the stronger pressing of the $n^{th}$ ceramic film formed on the one green sheet with the other green sheet adjacent to the one green sheet, there is a reduced tendency for separation to occur in the manufactured laminated inductor. Moreover, in a method of manufacture of laminated inductors of this invention, the connection conductive film is formed on the exposed face of the $n^{th}$ conductive film with a height from the green sheet greater than the height of the $n^{th}$ ceramic film from the green sheet. Hence, when laminating a plurality of green sheets, the connection conductive film formed on the exposed face of the $n^{th}$ conductive film on one green sheet is crushed by the other green sheet adjacent to this green sheet, and by means of this connection conductive film, the $n^{th}$ conductive film on one green sheet is reliably connected to the portion of the first conductive film on the other green sheet which fills through-holes formed in the other green sheet, to greatly improve the reliability of connection. Hence, both suppression of interlayer separation, and reduction of connection faults can be achieved.

It is preferable that the shrinkage rate during burning of the connection conductive film be smaller than the shrinkage rate during burning of the first to $n^{th}$ conductive film. As a result, there is little tendency for the connection conductive film to shrink during burning, so that even after burning, the connections between the $n^{th}$ conductive film on one green sheet and the portions of the first conductive film on other green sheet which fill through-holes in the other green sheet can be reliably maintained. As a result, connection faults can be further reduced.

By means of this invention, a laminated inductor in which there is extremely little tendency for cracking in portions of the laminate positioned between adjacent conductor patterns in the lamination direction even when conductor patterns are thick, as well as a method of manufacture of such laminated inductors, can be provided.

The present invention will be more fully understood from the detailed description given herein below and the accompanying drawings, which are given by way of illustration only, and thus are not to be considered as limiting the present invention.

DESCRIPTION OF THE PREFERRED EMBODIMENTS

Figure 1:
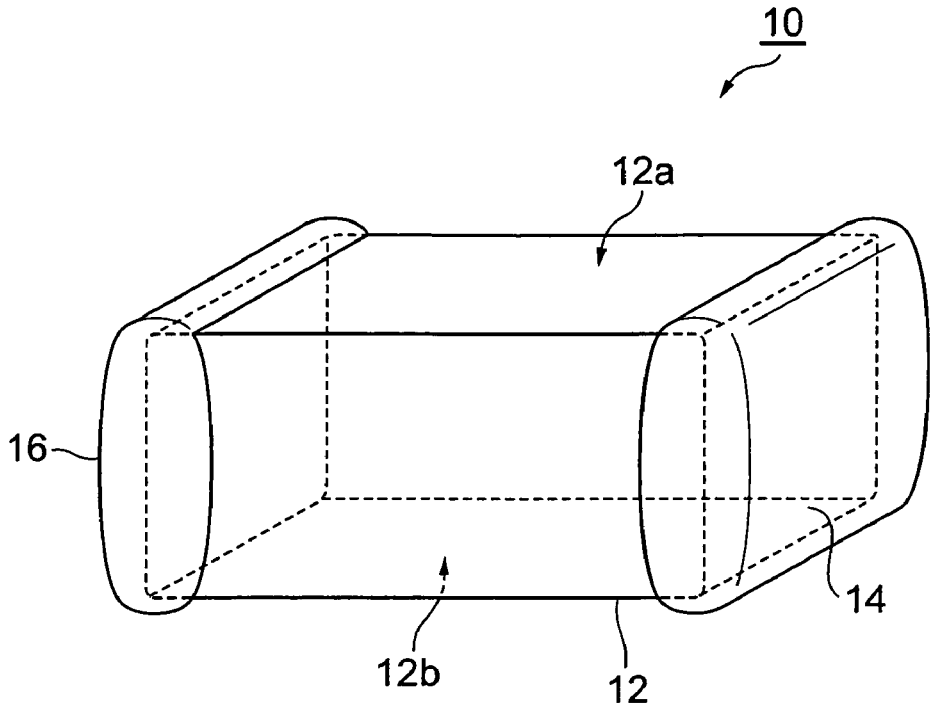
FIG. 1 is a perspective view of the laminated inductor of an embodiment.

Preferred embodiments of the invention are explained referring to the drawings. In the explanations, the same symbols are used for the same elements or for elements having the same functions, and redundant explanations are omitted.

(Configuration of Laminated Inductor)

Figure 2:
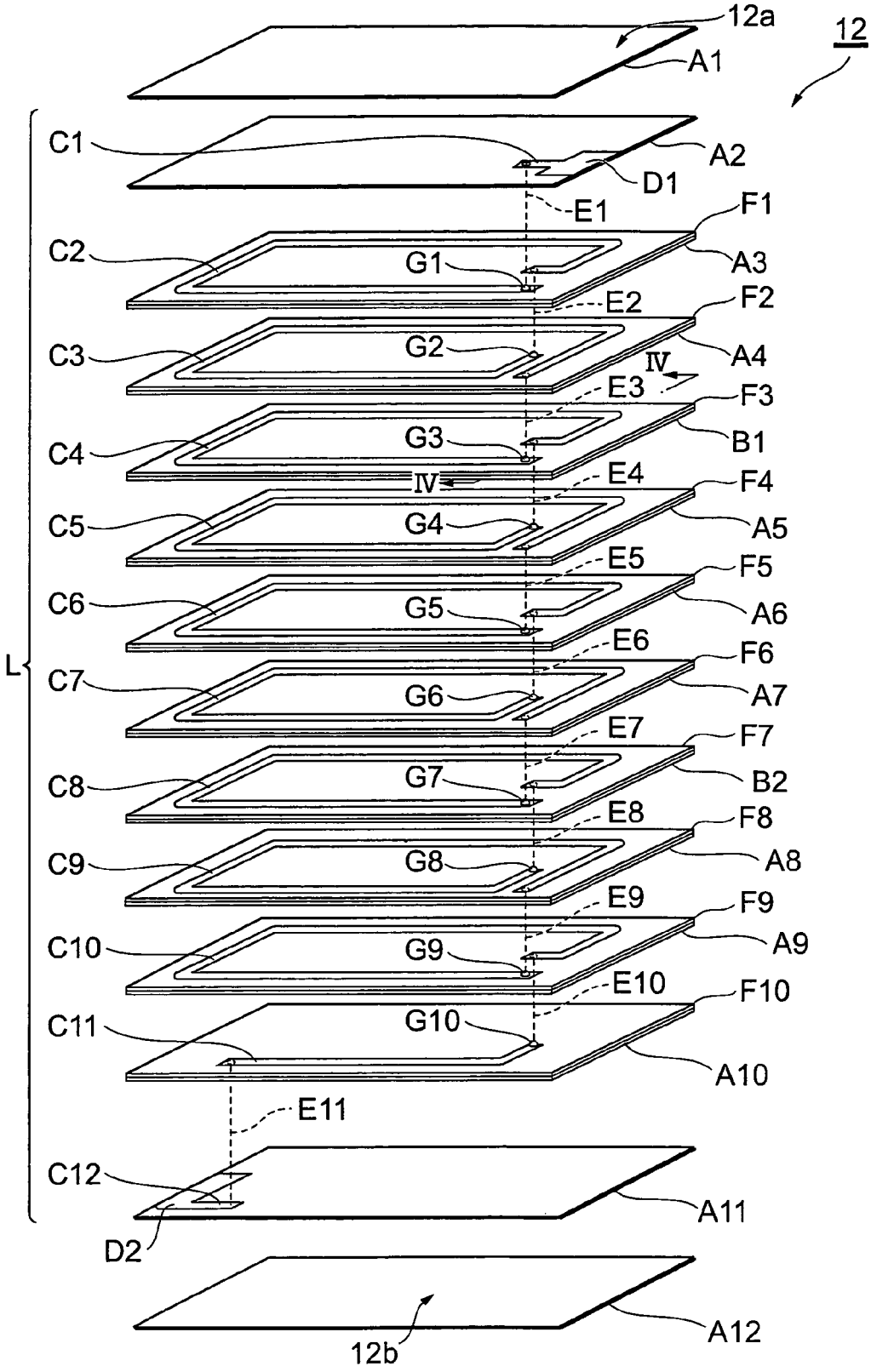
FIG. 2 is an exploded perspective view used to explain the configuration of a laminate comprised by the laminated inductor of this embodiment.

First, the configuration of the laminated inductor 10 of an embodiment is explained, referring to FIG. 1 to FIG. 5. As shown in FIG. 1 and FIG. 2, the laminated inductor 10 comprises a laminate 12 with substantially a rectangular parallelepiped shape; a pair of external electrodes 14 and 16, formed on the two peripheral side faces respectively in the length direction of the laminate 12; and a coil L, formed by electrically connecting each of conductor patterns C1 to C12 within the laminate 12.

The laminate 12 has a pair of main faces 12*a*, 12*b*, which are opposed so as to be substantially parallel. One among the main faces 12*a*, 12*b* is a face which, when the laminated inductor 10 is mounted on an external substrate (not shown), opposes the external substrate.

As shown in FIG. 2, the laminate 12 is formed by laminating, in order, magnetic layers A1 to A4, a nonmagnetic layer B1, magnetic layers A5 to A7, a nonmagnetic layer B2, and magnetic layers A8 to A12. That is, the upper face of the magnetic layer A1 forms the main face 12*a* of the laminate 12, and the lower face of the magnetic layer A12 forms the main face 12*b* of the laminate 12 (see FIG. 2); in this embodiment, the direction of opposition of the main faces 12*a* and 12*b* (hereafter called the "opposition direction") coincides with the lamination direction (hereafter the "lamination direction") of the laminate 12 (magnetic layers A1 to A12 and nonmagnetic layers B1 and B2).

The magnetic layers A1 to A12, the nonmagnetic layers B1 and B2, and magnetic films F1 to F10 described below function as insulators having electrical insulation properties. The magnetic layers A1 to A12 and the magnetic films F1 to F10 can be formed using, for example, Ni—Cu—Zn based ferrites, Cu—Zn based ferrites, or Ni—Cu—Zn—Mg based ferrites, or similar. The nonmagnetic layers B1 and B2 can for example be formed using Cu—Zn based nonmagnetic ferrites or other nonmagnetic ferrites. In an actual laminated inductor 10, the magnetic layers A1 to A12, the nonmagnetic layers B1 and B2, and the magnetic films F1 to F10 are integrated to such an extent that the boundaries therebetween cannot be perceived.

The conductor pattern C1 and a leading conductor D1 are formed on the surface of the magnetic layer A2. The conductor pattern C1 is arranged so as to be at the position of one end of the coil L. One end of the conductor pattern C1 is integrally formed with the leading conductor D1. The leading conductor D1 leads to the side on which the external electrode 12 of the magnetic layer A2 is formed, and the end portion thereof is exposed on an end face of the magnetic layer A2. Hence, the conductor pattern C1 is electrically connected to the external electrode 12 via the leading conductor D1. The other end of the conductor pattern C1 is electrically connected to a cylindrical through-hole conductor E1 which is formed penetrating the magnetic layer A2 in the thickness direction (that is, extends along the lamination direction). Hence, in the laminated state, the conductor pattern C1 is electrically connected to the corresponding conductor pattern C2 via the through-hole conductor E1 and a connection conductor G1 (which is described in detail below).

The conductor pattern C2 and the magnetic film F1 are formed on the surface of the magnetic layer A3. The conductor pattern C2 has a strip-like shape, and is equivalent to substantially one turn of the coil L, winding in a spiral shape over the magnetic layer A3. The connection conductor G1 is provided on the surface of one end of the conductor pattern C2; this connection conductor G1 is connected to the through-hole conductor E1 in the laminated state. That is, the conductor pattern C2 has an end portion which is connected with the through-hole conductor E1 via the connection conductor G1. The other end of the conductor pattern C2 is electrically connected to a cylindrical through-hole conductor E2, which is formed penetrating the magnetic layer A3 in the thickness direction (that is, extending along the lamination direction). Hence, in the laminated state, the conductor pattern C2 is electrically connected to the corresponding conductor pattern C3 via the through-hole conductor E2 and a connection conductor G2 (which is described in detail below).

The conductor pattern C3 and the magnetic film F2 are formed on the surface of the magnetic layer A4. The conductor pattern C3 has a strip-like shape, and is equivalent to substantially one turn of the coil L, winding in a spiral shape over the magnetic layer A4. The connection conductor G2 is provided on the surface of one end of the conductor pattern C3; this connection conductor G2 is connected to the through-hole conductor E2 in the laminated state. That is, the conductor pattern C3 has an end portion which is connected with the through-hole conductor E2 via the connection conductor G2. The other end of the conductor pattern C3 is electrically connected to a cylindrical through-hole conductor E3, which is formed penetrating the magnetic layer A4 in the thickness direction (that is, extending along the lamination direction). Hence, in the laminated state, the conductor pattern C3 is electrically connected to the corresponding conductor pattern C4 via the through-hole conductor E3 and a connection conductor G3 (which is described in detail below).

The conductor pattern C4 and the magnetic film F3 are formed on the surface of the nonmagnetic layer B1. The conductor pattern C4 has a strip-like shape, and is equivalent to substantially one turn of the coil L, winding in a spiral shape over the nonmagnetic layer B1. The connection conductor G3 is provided on the surface of one end of the conductor pattern C4; this connection conductor G3 is connected to the through-hole conductor E3 in the laminated state. That is, the conductor pattern C4 has an end portion which is connected with the through-hole conductor E3 via the connection conductor G3. The other end of the conductor pattern C4 is electrically connected to a cylindrical through-hole conductor E4, which is formed penetrating the nonmagnetic layer B1 in the thickness direction (that is, extending along the lamination direction). Hence, in the laminated state, the conductor pattern C4 is electrically connected to the corresponding conductor pattern C5 via the through-hole conductor E4 and a connection conductor G4 (which is described in detail below).

The conductor pattern C5 and the magnetic film F4 are formed on the surface of the magnetic layer A5. The conductor pattern C5 has a strip-like shape, and is equivalent to substantially one turn of the coil L, winding in a spiral shape over the magnetic layer A5. The connection conductor G4 is provided on the surface of one end of the conductor pattern C5; this connection conductor G4 is connected to the through-hole conductor E4 in the laminated state. That is, the conductor pattern C5 has an end portion which is connected with the through-hole conductor E4 via the connection conductor G4. The other end of the conductor pattern C5 is electrically connected to a cylindrical through-hole conductor E5, which is formed penetrating the magnetic layer A5 in the thickness direction (that is, extending along the lamination direction). Hence, in the laminated state, the conductor pattern C5 is electrically connected to the corresponding conductor pattern C6 via the through-hole conductor E5 and a connection conductor G5 (which is described in detail below).

The conductor pattern C6 and the magnetic film F5 are formed on the surface of the magnetic layer A6. The conductor pattern C6 has a strip-like shape, and is equivalent to substantially one turn of the coil L, winding in a spiral shape over the magnetic layer A6. The connection conductor G5 is provided on the surface of one end of the conductor pattern C6; this connection conductor G5 is connected to the through-hole conductor E5 in the laminated state. That is, the conductor pattern C6 has an end portion which is connected with the through-hole conductor E5 via the connection conductor G5. The other end of the conductor pattern C6 is electrically connected to a cylindrical through-hole conductor E6, which is formed penetrating the magnetic layer A6 in the thickness direction (that is, extending along the lamination direction). Hence, in the laminated state, the conductor pattern C6 is electrically connected to the corresponding conductor pattern C7 via the through-hole conductor E6 and a connection conductor G6 (which is described in detail below).

The conductor pattern C7 and the magnetic film F6 are formed on the surface of the magnetic layer A7. The conductor pattern C7 has a strip-like shape, and is equivalent to substantially one turn of the coil L, winding in a spiral shape over the magnetic layer A7. The connection conductor G6 is provided on the surface of one end of the conductor pattern C7; this connection conductor G6 is connected to the through-hole conductor E6 in the laminated state. That is, the conductor pattern C7 has an end portion which is connected with the through-hole conductor E6 via the connection conductor G6. The other end of the conductor pattern C7 is electrically connected to a cylindrical through-hole conductor E7, which is formed penetrating the magnetic layer A7 in the thickness direction (that is, extending along the lamination direction). Hence, in the laminated state, the conductor pattern C7 is electrically connected to the corresponding conductor pattern C8 via the through-hole conductor E7 and a connection conductor G7 (which is described in detail below).

The conductor pattern C8 and the magnetic film F7 are formed on the surface of the nonmagnetic layer B2. The conductor pattern C8 has a strip-like shape, and is equivalent to substantially one turn of the coil L, winding in a spiral shape over the nonmagnetic layer B2. The connection conductor G7 is provided on the surface of one end of the conductor pattern C8; this connection conductor G7 is connected to the through-hole conductor E7 in the laminated state. That is, the conductor pattern C8 has an end portion which is connected with the through-hole conductor E7 via the connection conductor G7. The other end of the conductor pattern C8 is electrically connected to a cylindrical through-hole conductor E8, which is formed penetrating the nonmagnetic layer B2 in the thickness direction (that is, extending along the lamination direction). Hence, in the laminated state, the conductor pattern C8 is electrically connected to the corresponding conductor pattern C9 via the through-hole conductor E8 and a connection conductor G8 (which is described in detail below).

The conductor pattern C9 and the magnetic film F8 are formed on the surface of the magnetic layer A8. The conductor pattern C9 has a strip-like shape, and is equivalent to substantially one turn of the coil L, winding in a spiral shape over the magnetic layer A8. The connection conductor G8 is provided on the surface of one end of the conductor pattern C9; this connection conductor G8 is connected to the through-hole conductor E8 in the laminated state. That is, the conductor pattern C9 has an end portion which is connected with the through-hole conductor E8 via the connection conductor G8. The other end of the conductor pattern C9 is electrically connected to a cylindrical through-hole conductor E9, which is formed penetrating the magnetic layer A8 in the thickness direction (that is, extending along the lamination direction). Hence, in the laminated state, the conductor pattern C9 is electrically connected to the corresponding conductor pattern C10 via the through-hole conductor E9 and a connection conductor G9 (which is described in detail below).

The conductor pattern C10 and the magnetic film F9 are formed on the surface of the magnetic layer A9. The conductor pattern C10 has a strip-like shape, and is equivalent to substantially one turn of the coil L, winding in a spiral shape over the magnetic layer A9. The connection conductor G9 is provided on the surface of one end of the conductor pattern C10; this connection conductor G9 is connected to the through-hole conductor E9 in the laminated state. That is, the conductor pattern C10 has an end portion which is connected with the through-hole conductor E9 via the connection conductor G9. The other end of the conductor pattern C10 is electrically connected to a cylindrical through-hole conductor E10, which is formed penetrating the magnetic layer A9 in the thickness direction (that is, extending along the lamination direction). Hence, in the laminated state, the conductor pattern C10 is electrically connected to the corresponding conductor pattern C11 via the through-hole conductor E10 and a connection conductor G10 (which is described in detail below).

The conductor pattern C11 and the magnetic film F10 are formed on the surface of the magnetic layer A10. The conductor pattern C11 has a strip-like shape, and is equivalent to substantially ⅜ turn of the coil L, forming an L shape over the magnetic layer A10. The connection conductor G10 is provided on the surface of one end of the conductor pattern C11; this connection conductor G10 is connected to the through-hole conductor E10 in the laminated state. That is, the conductor pattern C11 has an end portion which is connected with the through-hole conductor E10 via the connection conductor G10. The other end of the conductor pattern C11 is electrically connected to a cylindrical through-hole conductor E11, which is formed penetrating the magnetic layer A10 in the thickness direction (that is, extending along the lamination direction). Hence, in the laminated state, the conductor pattern C11 is electrically connected to the corresponding conductor pattern C12 via the through-hole conductor E11.

The conductor pattern C12 and a leading conductor D2 are formed on the surface of the magnetic layer A11. One end of the conductor pattern C12 comprises an area which is electrically connected to the through-hole electrode E11 in the laminated state. The other end of the conductor pattern C12 is integrally formed with the leading conductor D2. The leading conductor D2 leads to the side on which the external electrode 14 of the magnetic layer A11 is formed, and the end portion thereof is exposed on an end face of the magnetic layer A11. Hence, the conductor pattern C12 is electrically connected to the external electrode 14 via the leading conductor D2.

Figure 3:
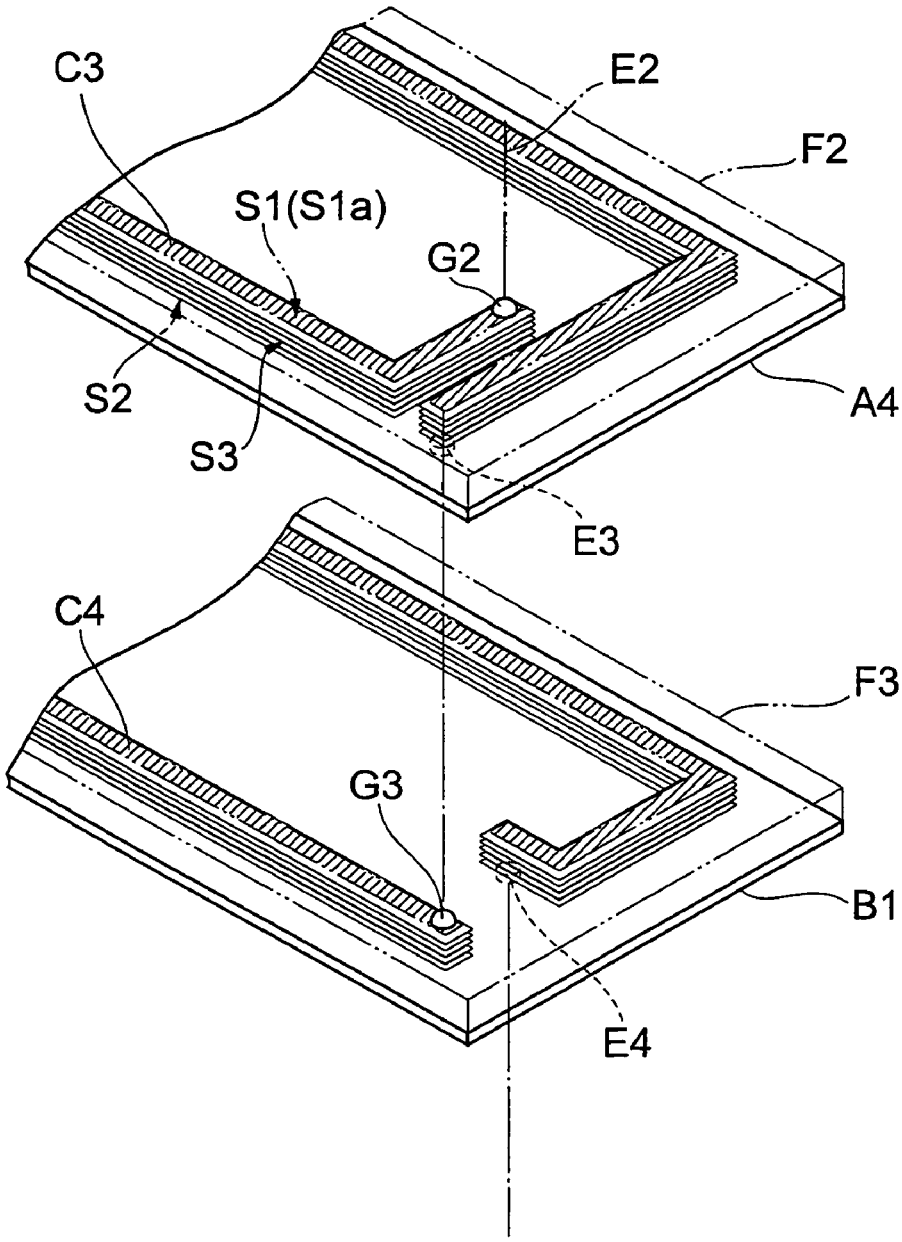
FIG. 3 is an exploded perspective view showing in enlargement a portion of FIG. 2.
Figure 4:
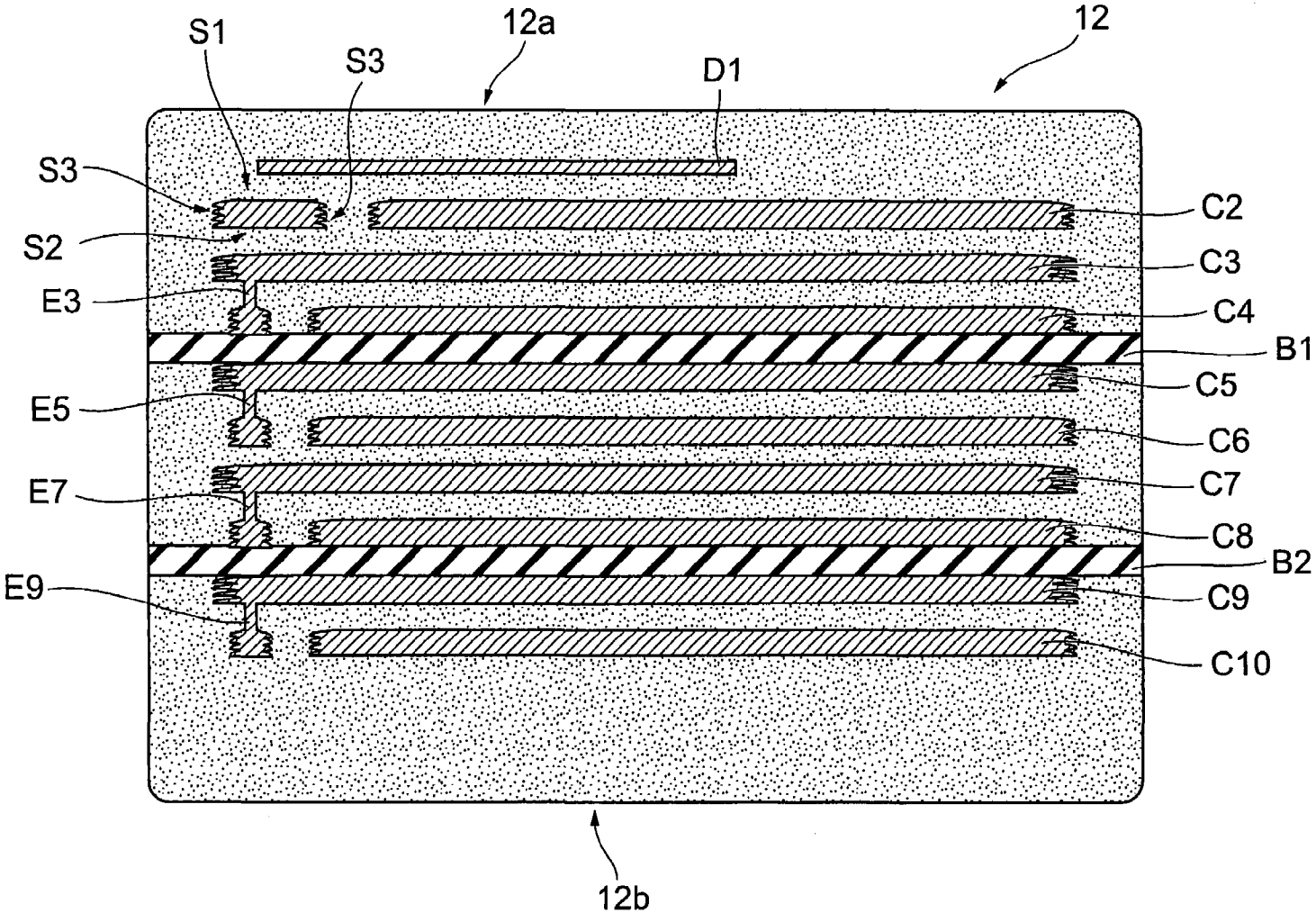
FIG. 4 is a cross-sectional view showing a state in which the laminate is sectioned along line IV-IV in FIG. 2.
Figure 5:
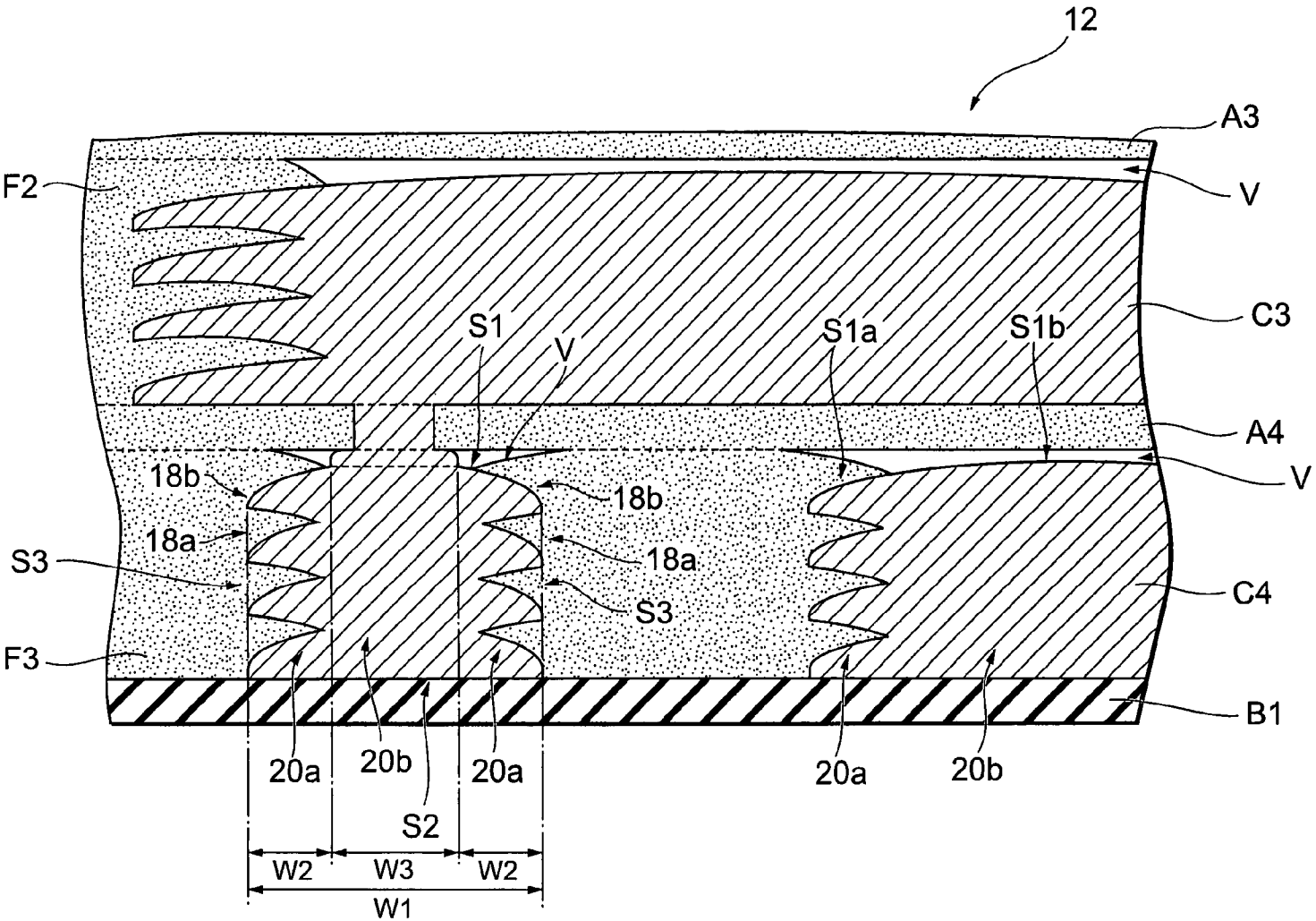
FIG. 5 is a cross-sectional view showing in enlargement a portion of FIG. 4.

Here, the configuration of the conductor patterns C2 to C11 is explained in greater detail, referring to FIG. 3 to FIG. 5. In FIG. 3 to FIG. 5, only portions of the conductor patterns C2 to C11 are shown, but the following explanation of the configuration of the conductor patterns C2 to C11 is common to all the conductor patterns.

The thickness of the conductor patterns C2 to C11 is set to 20 μm or greater, and it is preferable that the thickness be set to approximately 40 μm to 80 μm. If the thickness of the conductor patterns C2 to C11 is less than 20 μm, the cross-sectional area of the conductor patterns C2 to C11 is relatively small, and there is a tendency for the DC resistance value of the laminated inductor 10 to be large, making such a laminated inductor 10 unsuitable for large-current applications.

The conductor patterns C2 to C11 each have a pair of broad faces S1 and S2, in mutual opposition in the lamination direction, and peripheral side faces S3 connecting the broad face S1 and the broad face S2 along the entire perimeter of the pair of broad faces S1 and S2. The conductor patterns C2 to C11 are arranged within the laminate 12 such that the broad faces S1 are closer to the main face 12*a* and the broad faces S2 are closer to the main face 12*b* (see FIG. 4 in particular).

The peripheral side faces S3 of the conductor patterns C2 to C11 are concavo-convex faces in which concave portions 18*a* and convex portions 18*b* are arranged in alternation in the lamination direction, as shown in FIG. 3 to FIG. 5. The concave portions 18*a* and convex portions 18*b* extend along the peripheral direction of the peripheral side faces S3 over the entire perimeters of the peripheral side faces S3. As shown in FIG. 4 and FIG. 5, portions of the laminate 12 (magnetic films F1 to F10) enter into the concave portions 18*a*. Consequently, as shown in FIG. 5, when seen from the lamination direction the conductor patterns C2 to C11 have overlapping portions 20*a* in which portions of the laminate 12 (magnetic films F1 to F10) enter into concave portions 18*a*, and in which the conductor patterns C2 to C11 are overlapped, and non-overlapping portions 20*b* other than the overlapping portions 20*a*. On the other hand, the tips of the convex portions 18*b* have a tapered shape. The tips of the convex portions 18*b* substantially coincide with the edges of the broad faces S1 and S2 when seen from the lamination direction. Hence, the bottoms of the concave portions 18*a* overlap the broad faces S1 and S2 when seen from the lamination direction.

The width W1 of the conductor patterns C2 to C11 (see FIG. 5) is set to greater than 60 μm, and preferably is set to approximately 200 μm to 300 μm. The width W2 of the overlapping portions 20*a* (see FIG. 5) is set to 20 μm or greater, and so as to be smaller than the width W3 of the non-overlapping portions 20*b* (see FIG. 5). If the width W2 of the overlapping portion 20*a* is smaller than 20 μm, the anchor effect occurring due to the depression/protrusion shape of the peripheral side faces S3 (the effect by which there is little tendency for separation of the laminate 12 from the concavo-convex shape peripheral side faces S3) tends to be inadequate. If the width W2 of the overlapping portions 20*a* is equal to or greater than the width W3 of the non-overlapping portions 20*b*, the cross-sectional area of the conductor patterns C2 to C11 is relatively small, the DC resistance value of the laminated inductor 10 tends to be large, and such a laminated inductor 10 is not suitable for large-current applications.

As shown in FIG. 5, the areas S1*a* in the overlapping portions 20*a* among the broad faces S1 of the conductor patterns C2 to C11 are in contact with the laminate 12 (magnetic films F1 to F10). On the other hand, as shown in FIG. 5, the areas S1*b* in the non-overlapping portions 20*b* among the broad faces S1 of the conductor patterns C2 to C11 are not in contact with the laminate 12 (magnetic films F1 to F10). Moreover, the portions of the areas S1*b* corresponding to the through-hole conductors E1 to E10 have a cylindrical shape or a truncated hemispherical shape, and moreover connection conductors G1 to G10 are positioned which, when seen from the lamination direction, are larger than the through-hole conductors E1 to E10. That is, the connection conductors G1 to G10 are provided only at the end portions of the conductor patterns C2 to C11. Between the portions of the areas S1*b* excluding the portions in which the connection conductors G1 to G10 are positioned (that is, the areas indicated by diagonal lines in FIG. 3) and the laminate 12, gaps V are formed (see FIG. 5).

The broad faces S2 of the conductor patterns C2 to C11 are in contact with the laminate 12 either entirely or for the most part, as shown in FIG. 3 to FIG. 5.

The above-described conductor patterns C1 to C12 and the leading conductors D1 and D2 can for example be formed using Ag or another metal material. The thicknesses of the above-described conductor patterns C1 and C12 and the leading conductors D1 and D2 can be set to approximately 10 μm to 25 μm, and the widths of the above-described conductor patterns C1 and C12 can be set to approximately 200 μm to 300 μm.

(Method of Manufacture of Laminated Inductor)

Next, a method of manufacture of laminated inductors 10 of this embodiment is explained, referring to FIG. 6 to FIG. 9. In FIG. 6 to FIG. 9, only a portion of magnetic green sheets GS1 and of nonmagnetic green sheets GS2 are shown; but the processes for formation of conductive films H1 to H4 and magnetic films I1 to I4 described below on the magnetic green sheet GS1 or the nonmagnetic green sheet GS2 are all common to all sheets.

First, a magnetic slurry, nonmagnetic slurry, conductive paste and connection conductive paste are prepared. Specifically, the magnetic slurry is obtained by for example kneading Ni—Cu—Zn based ferrite powder, Cu—Zn based ferrite powder, or Ni—Cu—Zn—Mg based ferrite powder, or another magnetic powder, with a binder and solvent. The nonmagnetic slurry is obtained by for example kneading Cu—Zn based nonmagnetic ferrite powder, or another nonmagnetic powder, with a binder and solvent. The conductive paste and connection conductive paste are prepared by for example mixing a conductive powder with a binder and organic solvent at a prescribed mixing ratio, and then kneading. As the conductive powder, normally Ag, an Ag alloy, Cu, a Cu alloy, or similar can be used; however, it is preferable that Ag, with its low resistivity, be used. In kneading, three rollers, a homogenizer, a sand mill, or similar can be used. In order to ensure that the shrinkage after burning of the connection conductor paste is smaller than conductive paste shrinkage after burning, for example the types and amounts of binders and solvents in the conductive paste and in the connection conductive paste are modified.

Figure 8:
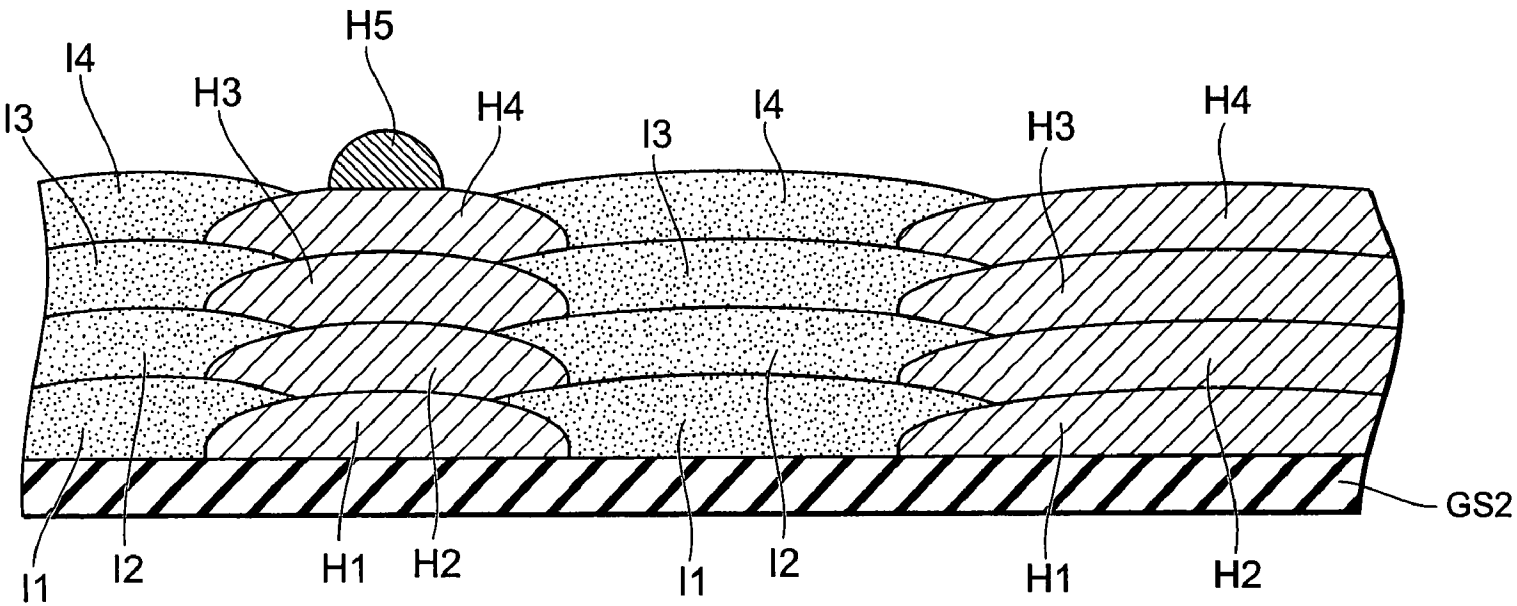
FIG. 8 shows a process following that of FIG. 7.
Figure 9:
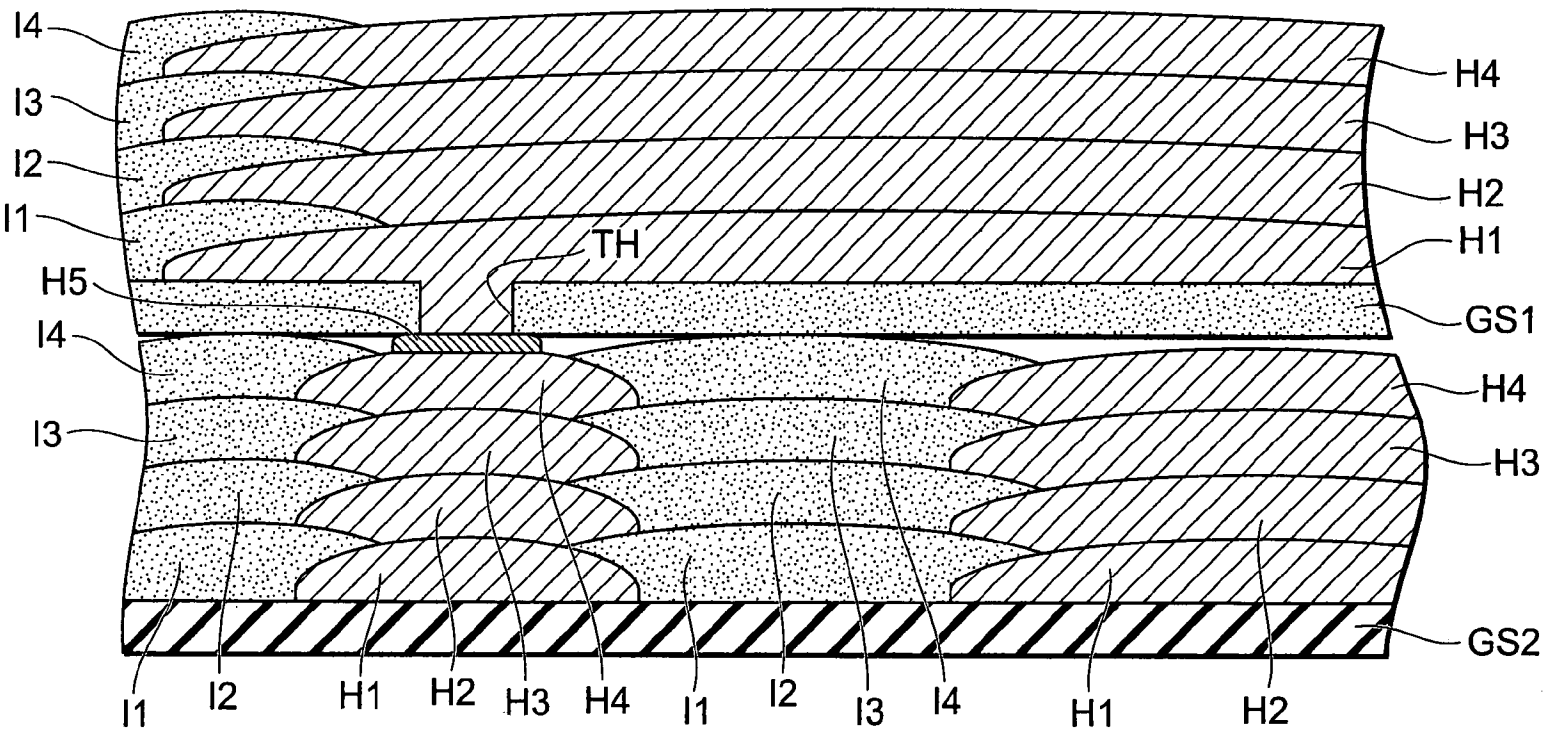
FIG. 9 shows a process following that of FIG. 8; and, (a) of FIG. 10 is a figure which explains the amount of protrusion X of the conductive film, and (b) of FIG. 10 shows the relationship between the amount of protrusion X of the conductive film and the rate of line breakage and the rate of occurrence of cracking.

Next, a doctor blade method or printing method, for example, is used to apply the magnetic slurry onto a PET film or other support member, to form magnetic green sheets GS1 serving as the magnetic layers A1 to A12 (see FIG. 9). Also, the nonmagnetic slurry is applied to a PET film or other support layer using for example a doctor blade method or printing method, to form the nonmagnetic green sheets GS2 serving as the nonmagnetic layers B1 and B2 (see FIG. 6 to FIG. 9). The thicknesses of these magnetic green sheets GS1 and nonmagnetic green sheets GS2 can be set to, for example, approximately 10 μm to 30 μm. Then, laser machining is performed to form through-holes TH (see FIG. 9) penetrating the magnetic green sheets GS1 and nonmagnetic green sheets GS2 in the thickness direction at prescribed positions, and the through-holes TH are filled with conductive paste.

Next, conductive paste is applied in a prescribed pattern onto the magnetic green sheet GS1 which is to become the magnetic layer A2, and by drying for less than 1 hour at approximately 40° C. to 80° C., a strip-like conductive film serving as the conductor pattern C1 and leading conductor D1 is formed. Similarly, by applying conductive paste in a prescribed pattern onto the magnetic green sheet GS1 which is to become the magnetic layer A11, a strip-like conductive film serving as the conductor pattern C12 and leading conductor D2 is formed. The thickness of the conductive films serving as these conductor patterns C1 and C12 and leading conductors D1 and D2 can be set to approximately 10 μm to 25 μm, and the widths of the conductive films serving as these conductor patterns C1 and C12 can be set to approximately 200 μm to 300 μm.

Figure 6:
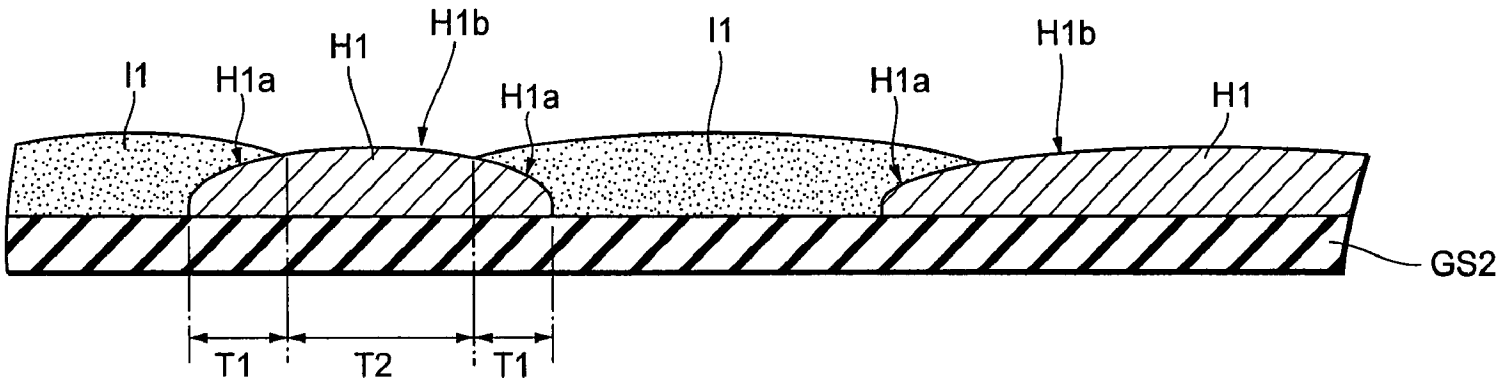
FIG. 6 shows a process in the manufacture of the laminated inductor of this embodiment.

Next, the conductive films serving as the conductor patterns C2 to C11 and magnetic films serving as the magnetic films F1 to F10 are formed on the magnetic green sheets GS1 which are to become the magnetic layers A3 to A10 and on the nonmagnetic green sheets GS2 which are to become the nonmagnetic layers B1 and B2. Specifically, as shown in FIG. 6, first conductive paste is applied in prescribed patterns onto the magnetic green sheets GS1 which are to become the magnetic layers A3 to A10 and onto the nonmagnetic green sheets GS2 which are to become the nonmagnetic layers B1 and B2, and by drying for less than 1 hour at approximately 40° C. to 80° C., strip-like conductive films H1 are formed. The thickness of these conductive films H1 can be set to approximately 15 μm to 30 μm, and the width can be set to approximately 200 μm to 300 μm.

Then, magnetic slurry is applied so as to cover the edge portions H1*a* of the conductive films H1 and so as to expose the upper face of the center portions H1*b* other than the edge portions H1*a* of the conductive films H1, and by drying for less than 1 hour at approximately 40° C. to 80° C., magnetic films I1 are formed. The thickness of these magnetic films I1 is set to be greater than the thickness of the conductive films H1, and it is preferable that the thickness be set to approximately 20 μm to 40 μm. That is, the height of the magnetic films I1 from the magnetic green sheets GS1 or nonmagnetic green sheets GS2 is greater than the height of the conductive films H1 from the magnetic green sheets GS1 or nonmagnetic green sheets GS2.

It is preferable that the width T1 of the edge portions H1*a* of the conductive films H1 be set to approximately 20 μm to 40 μm. It is preferable that the width T2 of the center portions H1*b* of the conductive films H1 be set to approximately 150 μm to 270 μm.

Figure 7:
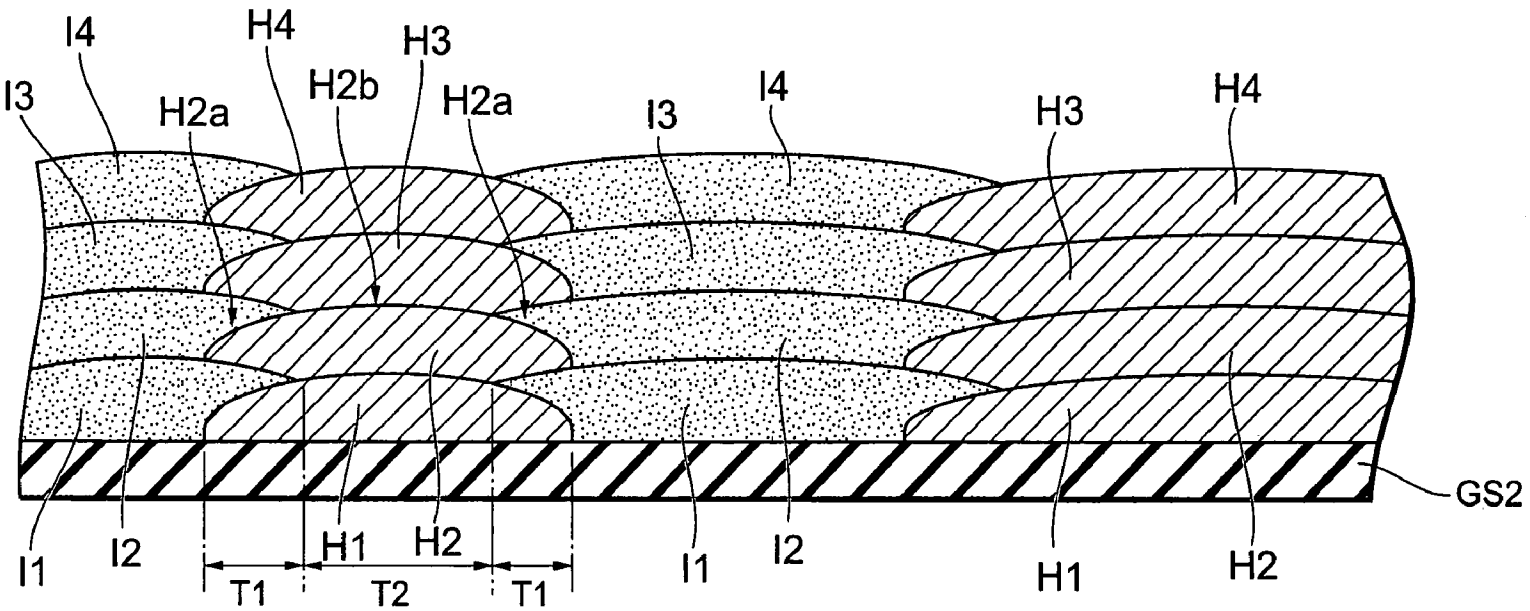
FIG. 7 shows a process following that of FIG. 6.

Next, as shown in FIG. 7, conductive paste is applied, in the same pattern as the conductive films H1, onto the exposed faces of the conductive films H1 and onto the magnetic films I1, and by drying for less than 1 hour at approximately 40° C. to 80° C., strip-like conductive films H2 are formed. The thickness and width of the conductive films H2 can be set to approximately the same values as for the conductive films H1.

Then, magnetic slurry is applied so as to cover the edge portions H2*a* of the conductive films H2 and so as to expose the upper face of the center portions 112*b* other than the edge portions H2*a* of the conductive films H2, and by drying for less than 1 hour at approximately 40° C. to 80° C., magnetic films I2 are formed. The thickness of these magnetic films I2 is set to be greater than the thickness of the conductive films H2, and it is preferable that the thickness be set to approximately the same as the thickness of the magnetic films I1. That is, the height of the magnetic films I2 from the magnetic green sheets GS1 or nonmagnetic green sheets GS2 is greater than the height of the conductive films H2 from the magnetic green sheets GS1 or nonmagnetic green sheets GS2.

Next, as shown in FIG. 7, conductive films H3, magnetic films I3, conductive films H4, and magnetic films I4 are formed, in this order, similarly to the conductive films H2 and magnetic films I2. Hence, the height of the magnetic films I4, which are at the uppermost positions among the magnetic films I1 to I4, from the magnetic green sheets GS1 or nonmagnetic green sheets GS2, is greater than the height of the conductive films H4, which are at the uppermost positions among the conductive films H1 to H4, from the magnetic green sheets GS1 or nonmagnetic green sheets GS2.

Next, as shown in FIG. 8, connection conductive paste is applied so as to form hemispherical shapes on the exposed faces of the conductive films H4, which are at the uppermost positions among the magnetic films I1 to I4, and by drying for less than 1 hour at approximately 40° C. to 80° C., connection conductive films H5 are formed. That is, the connection conductive films H5 are not applied onto the magnetic films I4, but are formed only on end portions of the conductive films H4.

The height of the connection conductive films H5 from the magnetic green sheets GS1 or nonmagnetic green sheets GS2 is greater than the height of the magnetic films I4, which are at the uppermost positions among the magnetic films I1 to I4, from the magnetic green sheets GS1 or nonmagnetic green sheets GS2. The thickness of the connection conductive films H5 can be set to approximately 10 μm to 30 μm.

Next, the magnetic green sheets GS1 which are to become the magnetic layers A1 to A12 and the nonmagnetic green sheets GS2 which are to become the nonmagnetic layers B1 and B2 are laminated in the order shown in FIG. 2, and pressure is applied in the lamination direction to perform pressure-bonding, to form a green sheet laminate (not shown). At this time, as shown in FIG. 9, connection conductive films H5 are crushed by the other green sheets which are adjacent in the lamination direction, and the connection conductive films H5 are connected to the portions of the conductive films H1 of the other green sheets which fill the interiors of through-holes TH in the other green sheets.

Next, after cutting the green sheet laminate into chip units, burning is performed for 10 hours or more at approximately 850° C. to 900° C., to fabricate laminates 12. After burning, a laminate 12 has, for example, a length of approximately 2.5 mm, width of approximately 2.0 mm, and height of approximately 1.0 mm. As a result, the magnetic green sheets GS1 become the magnetic layers A1 to A12, the nonmagnetic green sheets GS2 become the nonmagnetic layers B1 and B2, the conductive films H1 to H4 become the various conductor patterns C2 to C11, the magnetic films I1 to I4 become the various magnetic films F1 to F10, and the connection conductive films H5 become the various connection conductors G1 to G10. The shrinkage rate during burning of the conductive films is set to for example approximately 15% to 25%, and the shrinkage rate during burning of the green sheets GS1 and GS2 and of the magnetic films is set to for example approximately 10% to 20%. Further, because the conductive paste and the connection conductive paste differ as explained above, the shrinkage rate during burning of the connection conductive films H5 is smaller than the shrinkage rate during burning of the conductive films.

Next, external electrodes 14 and 16 are formed on this laminate 12. By this means, a laminated inductor 10 is formed. The external electrodes 14 and 16 are formed by transferring a conductive paste, the main component of which is Ag, Cu or Ni, on both sides in the length direction of the laminate 12, and then burning at a prescribed temperature (for example, 700° C. to 800° C.), and then performing electroplating. In electroplating, Cu, Ni or Sn can for example be used.

(Operation)

As described above, in this embodiment, the peripheral side faces S3 of the conductor patterns C2 to C11 are concavo-convex faces in which concave portions and convex portions are arranged in alternation in the lamination direction, and a portion of the laminate 12 enters into the concave portions 18*a* of these peripheral side faces S3. Hence, due to the so-called anchor effect, there is extremely little tendency for separation of the portions of the laminate 12 in contact with the peripheral side faces S3 of the conductor patterns from the concavo-convex shape peripheral side faces. As a result, even when the conductor patterns C2 to C11 are thick (20 μm or greater), there is extremely little tendency for cracking to occur in portions of the laminate 12 positioned between adjacent conductor patterns in the lamination direction. Hence, concerns about short-circuits between adjacent conductor patterns due to the migration phenomenon are greatly reduced.

Further, in this embodiment the tips of the convex portions 18*b* of the peripheral side faces S3 have a tapered shape. Hence, portions of the laminate 12 in contact with the peripheral side faces S3 of conductor patterns do not readily tend to separate from the concavo-convex shape peripheral side faces S3.

Further, between the portions of the areas S1*b* excluding the portions in which connection conductors G1 to G10 are positioned (that is, the areas indicated by diagonal lines in FIG. 3) and the laminate 12, gaps V are formed. Hence, because the relative permittivity of air is normally lower than the relative permittivity of the laminate 12, the distributed capacitance is small. As a result, losses at high frequencies can be made small.

Further, in this embodiment the conductor patterns C2 to C11 are connected to the through-hole conductors E1 to E10 respectively via the connection conductors G1 to G10. And, when seen from the lamination direction, the connection conductors G1 to G10 are larger than the through-hole conductors E1 to E10, and are positioned within the areas S1*b* of the broad faces S1 of the conductor patterns C2 to C11 in the non-overlapping portions 20*b*. Hence, the conductor patterns C2 to C11 are reliably connected to the through-hole conductors E1 to E10 by the connection conductors G1 to G10, respectively, so that connection reliability can be greatly improved.

Further, in this embodiment the height of the magnetic films I4, which are at the uppermost positions among the magnetic films I1 to I4, from the magnetic green sheets GS1 or nonmagnetic green sheets GS2 is greater than the height of the conductive films H4, which are at the uppermost positions among the conductive films H1 to H4, from the magnetic green sheets GS1 or nonmagnetic green sheets GS2. As a result, uniform pressure-bonding of the green sheet laminate as a whole is possible. Consequently, the occurrence of interlayer separation in the manufactured laminated inductor 10 can be adequately suppressed.

In a method of manufacture of laminated inductors of the prior art, an auxiliary magnetic material layers were formed surrounding the periphery of the conductor patterns on the magnetic green sheets, and had thicknesses greater than that of the conductor patterns (see for example Japanese Examined Patent Publication No. 7-123091). However, in a laminated inductor manufactured in this way, one of the broad faces among the broad faces of the strip-like conduction patterns became separated from the laminate. Hence, adjacent conductor patterns in the lamination direction were not electrically connected via through-hole conductors, and connection faults sometimes occurred.

On the other hand, formation on the magnetic green sheets of auxiliary magnetic material layers, surrounding the periphery of the conductor patterns, which are thinner than the thickness of the conductor patterns is also conceivable. However, in this case, the green sheet laminate as a whole, in which green sheets are laminated, cannot be subjected to uniform pressure bonding, and there has been the problem that interlayer separation occurs in laminated inductors manufactured in this way.

Figure 10:
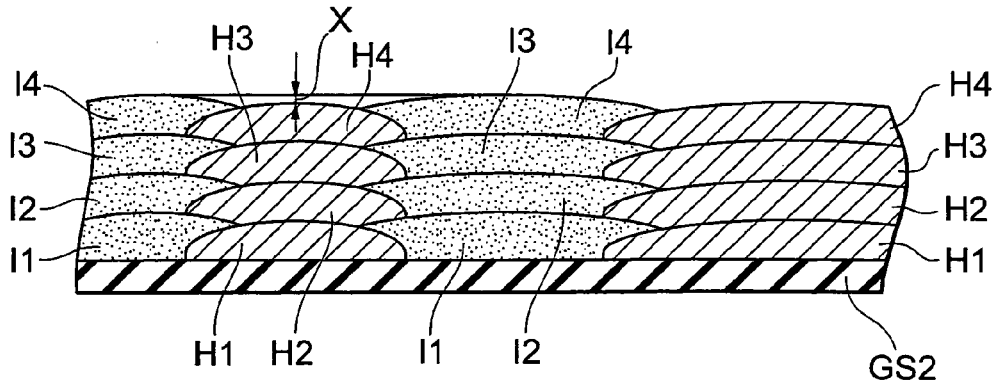
Figure 10:
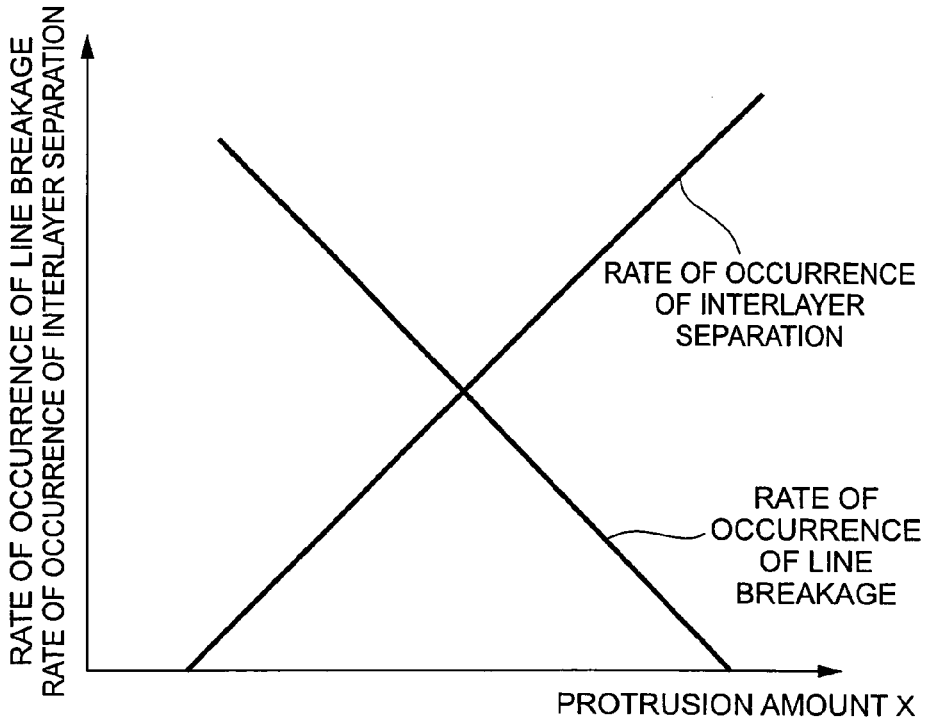

These methods of the prior art may be discussed in light of this embodiment as follows. That is, when the difference between the height from the magnetic green sheet GS1 or nonmagnetic green sheet GS2 of the conductive films H4 positioned uppermost among the conductive films H1 to H4, and the height from the magnetic green sheet GS1 or nonmagnetic green sheet GS2 of the magnetic films I4 positioned uppermost among the magnetic films I1 to I4, is stipulated as a protrusion amount X of the conductive film H4 from the magnetic film I4 (see (a) of FIG. 10), then as shown in (b) of FIG. 10, the smaller the protrusion amount X, the higher is the rate of occurrence of line breakage, although the rate of occurrence of interlayer separation is decreased; on the other hand, the larger the protrusion amount X, the higher is the rate of occurrence of interlayer separation, although the rate of occurrence of line breakage is decreased. Hence, in the prior art it has been difficult to achieve both reduced occurrence of interlayer separation and a reduction in connection faults.

However, in the embodiment described above, the magnetic films I1 to I4 are formed so as to respectively cover the edge portions of the conductive films H1 to H4 while exposing the upper faces of the conductive films H1 to H4 other than the edge portions, and the height of the magnetic films I4 from the magnetic green sheets GS1 or nonmagnetic green sheets GS2 is greater than the height of the conductive films H4 from the magnetic green sheets GS1 or nonmagnetic green sheets GS2. For this reason, the protrusion amount X is small, and so the area of contact of a magnetic film I4 formed on one green sheet with the green sheet adjacent to the one green sheet is increased, and together with the stronger pressing of the magnetic film I4 and the other green sheet due to the edge portions of the conductive film H4, there is less tendency for interlayer separation in the laminated inductor 10. Also, in this embodiment connection conductive films H5 are formed on the exposed faces of conductive films H4 positioned uppermost among the conductive films H1 to H4, and the height of the connection conductive films H5 from the magnetic green sheets GS1 or nonmagnetic green sheets GS2 is greater than the height of the magnetic films I4 from the magnetic green sheets GS1 or nonmagnetic green sheets GS2. For this reason, when the magnetic green sheets GS1 which become magnetic layers A1 to A12 and nonmagnetic green sheets GS2 which become nonmagnetic layers B1 and B2 are laminated in the order shown in FIG. 2, the connection conductive films H5 are crushed by the other green sheet adjacent in the lamination direction, so that the connection conductive films H5 are reliably connected to the portion of the conductive film H1 on the other green sheet which fills the through-hole TH in the other green sheet, and connection reliability is greatly improved. Hence, both reduced occurrence of interlayer separation and a reduction in connection faults can be achieved.

Further, in this embodiment, the shrinkage rate at the time of burning of the connection conductor films H5 is lower than the shrinkage rate at the time of burning of the conductive films. Hence, during burning, there is little tendency for shrinkage of connection conductive films H5, so that even after burning, the connection between the conductive film H4 on one green sheet and the portion of the conductive film H1 on the other green sheet which fills the through-hole TH of the other green sheet can be reliably maintained. As a result, connection faults can be further reduced.

In the above, preferred embodiments of the invention have been explained in detail; however, the invention is not limited to the above-described embodiments. For example, in this embodiment the laminate 12 comprises the magnetic layers A1 to A12 and the nonmagnetic layers B1 and B2; however, the laminate is not limited to this configuration, and the entirety may be formed from magnetic material, or the entirety may be formed from nonmagnetic material. However, in order to suppress magnetic saturation and limit reductions in the inductance value when large currents flow, from the standpoint of further improving the DC superpositioning characteristics, it is preferable that, as in this embodiment, the laminate be configured with a nonmagnetic layer B1 inserted between the magnetic layers A4 and A5, and with a nonmagnetic layer B2 inserted between the magnetic layers A7 and A8.

Also, in these embodiments hemispherical connection conductive films H5 are formed, and so the connection conductors G1 to G10 are cylindrical or have a truncated hemispherical shape; but other shapes may be used. That is, the connection conductors G1 to G10 may be square columns, truncated four-sided pyramids (four-sided frustums), three-sided columns, truncated three-sided pyramids (three-sided frustums), or various other shapes.

Further, in these embodiments four layers each of the conductive films H1 to H4 and magnetic films I1 to I4 were formed in alternation; however, from the standpoint of obtaining an anchor effect, it is sufficient to form two or more layers each of conductive films and magnetic films in alternation.

Further, in these embodiments four layers each of the conductive films H1 to H4 and magnetic films I1 to I4 were formed in alternation; however, from the standpoint of enhancing the reliability of connection by the connection conductors G1 to G10, it is sufficient to form one or more layers each of conductive films and magnetic films in alternation.

Further, in these embodiments the convex portions 18*b* of the peripheral side faces S3 had a tip shape which was tapered in moving in the direction away from the conductor patterns C2 to C11; but if the peripheral side faces S3 are concavo-convex faces, the convexprotruding portions 18*b* need not be tapered.

It is apparent that various embodiments and modifications of the present invention can be embodied, based on the above description. Accordingly, it is possible to carry out the present invention in modes other than the above best modes, within the following scope of claims and the scope of equivalents thereto.

What is claimed is:

1. A laminated inductor, comprising:

a laminate formed by laminating a plurality of insulator layers;

first and second external electrodes, positioned on outer surfaces of the laminate respectively;

a coil, formed by electrically connecting a plurality of strip-like conductor patterns, and arranged within the laminate;

a first leading conductor, electrically connected to one end of the coil, and electrically connected to the first external electrode; and a second leading conductor, electrically connected to the other end of the coil, and electrically connected to the second external electrode, wherein the conductor pattern has first and second broad faces, mutually opposing in a lamination direction of the laminate, and peripheral side faces connecting the first and second broad faces over the entire perimeter of the first and second broad faces, and is set to have a thickness of 20 μm or greater;

the peripheral side faces have concave portions extending along a peripheral direction and convex portions extending along the peripheral direction, which are arranged in alternation along the lamination direction to form concavo-convex faces; and by causing a portion of the laminate to enter into the concave portions of the peripheral side faces, the conductor pattern, seen from the lamination direction, has overlapping portions, in which portions, of the laminate, which enter into the concave portions in the peripheral side faces, overlap the conductor pattern, and non-overlapping portions, which are portions other than the overlapping portions.

2. The laminated inductor according to claim 1, wherein the width of the conductor pattern is set to be larger than 60 μm, and the width of the overlapping portions is set to be 20 μm or greater, but smaller than the width of the non-overlapping portions.

3. The laminated inductor according to claim 1, wherein tips of the convex portions in the peripheral side faces have a tapered shape.

4. The laminated inductor according to claim 1, wherein the laminate has first and second main faces, which intersects the lamination direction and are mutually opposed;

the conductor pattern is arranged within the laminate such that the first broad faces are closer to the first main face and the second broad faces are closer to the second main face;

the tips of the convex portions, when seen from the lamination direction, substantially coincide with edges of the first and second broad faces, so that as a result bottoms of the concave portions overlap the first and second broad faces when seen from the lamination direction;

regions on the first broad faces in the overlapping portions are in contact with the laminate; and a gap is formed between a portion of the regions of the first broad faces in the non-overlapping portions and the laminate.

5. The laminated inductor according to claim 4, wherein the conductor pattern has end portions connected to through-hole conductors extending in the lamination direction;

the conductor pattern and the through-hole conductors are connected via connection conductors provided only at the end portions of the conductor pattern; and the connection conductors are arranged so as to be larger than the through-hold conductors when seen from the lamination direction and so as to be within regions in the non-overlapping portions of the first broad faces.

6. A method of manufacturing a laminated inductor, comprising the steps of:

preparing a green sheet;

forming a strip-like first conductive film by applying a conductive paste onto the green sheet in a prescribed pattern and performing drying;

applying a ceramic slurry so as to cover edge portions of the first conductive film and expose an upper face of the first conductive film other than the edge portions, and performing drying to form a first ceramic film;

applying a conductive paste on the exposed face of the first conductive film and on the first ceramic film in the prescribed pattern and performing drying, in order to form a strip-like second conductive film, which overlaps with the first conductive film when seen from the lamination direction; and applying a ceramic slurry so as to cover edge portions of the second conductive film and expose an upper face of the second conductive film other than the edge portions, and performing drying, in order to form a second ceramic film.

7. The method of manufacturing a laminated inductor according to claim 6, wherein in the step of forming the first ceramic film, the first ceramic film is formed such that the height of the first ceramic film from the green sheet is higher than the height of the first conductive film from the green sheet, and such that, in the step of forming the second ceramic film, the second ceramic film is formed such that the height of the second ceramic film from the green sheet is higher than the height of the second conductive film from the green sheet.

8. The method of manufacturing a laminated inductor according to claim 7, further comprising a step, after the step of preparing the green sheet, and before the step of forming the first conductive film, of forming a through-hole in the green sheet which penetrates in the thickness direction, wherein in the step of forming the first conductive film, conductive paste is used to fill the through-hole and conductive paste is applied in a prescribed pattern onto the green sheet and drying is performed to form a strip-like first conductive film, and the method further comprising a step, after the step of forming the second ceramic film, of forming a connection conductive film, in which conductive paste is applied only to an end portion of the second conductive film which is the exposed face of the second conductive film and drying is performed, such that the connection conductive film has the height from the green sheet greater than the height of the ceramic film from the green sheet.

9. The method of manufacturing a laminated inductor according to claim 8, wherein a shrinkage rate during burning of the connection conductive film is smaller than a shrinkage rate during burning of the conductive film.

10. A method of manufacturing a laminated inductor, comprising the steps of:

preparing a green sheet;

forming a through-hole in the green sheet which penetrates in a thickness direction;

forming a strip-like first conductive film by filling the through-hole with conductive paste and applying conductive paste onto the green sheet in a prescribed pattern and performing drying;

applying a ceramic slurry so as to cover edge portions of the first conductive film and expose an upper face of the first conductive film other than the edge portions and performing drying, in order to form a first ceramic film having the height from the green sheet greater than the height of the first conductive film from the green sheet;

forming a strip-like $n^{th}$ (where n is an integer equal to or greater than 2) conductive film;

forming an $n^{th}$ ceramic film; and forming a connection conductive film, wherein in the step of forming the $n^{th}$ conductive film, by applying conductive paste in the prescribed pattern onto the exposed face of the $m^{th}$ (where m is the integer satisfying $m=n-1$) conductive film and onto the $m^{th}$ ceramic film and by performing drying, the $n^{th}$ conductive film is formed so as to overlap the $m^{th}$ conductive film when seen from the lamination direction and to have the height, from the green sheet, greater than the height of the $m^{th}$ ceramic film from the green sheet;

in the step of forming the $n^{th}$ ceramic film, by applying ceramic slurry so as to cover edge portions of the $n^{th}$ conductive film and expose an upper face of the $n^{th}$ conductive film other than the edge portions and by performing drying, the $n^{th}$ ceramic film is formed to have the height, from the green sheet, greater than the height of the $n^{th}$ conductive film from the green sheet; and in the step of forming the connection conductive film, by applying conductive paste only onto end portions of the $n^{th}$ conductive film which is the exposed face and by performing drying, the connection conductive film is formed to have the height, from the green sheet, greater than the height of the $n^{th}$ ceramic film from the green sheet.

11. The method of manufacturing a laminated inductor according to claim 10, wherein a shrinkage rate during burning of the connection conductive film is smaller than a shrinkage rate during burning of the first to $n^{th}$ conductive films.

* * * * *